US007565786B2

(12) United States Patent
Miksch

(10) Patent No.: US 7,565,786 B2
(45) Date of Patent: Jul. 28, 2009

(54) METHOD AND DEVICE FOR REMOVING A COVER FROM A STORAGE BOX

(75) Inventor: Rupert Miksch, Satteldorf (DE)

(73) Assignee: Groninger & Co. GmbH, Crailsheim (DE)

( * ) Notice: Subject to any disclaimer, the term of this patent is extended or adjusted under 35 U.S.C. 154(b) by 523 days.

(21) Appl. No.: 11/037,327

(22) Filed: Jan. 18, 2005

(65) Prior Publication Data

US 2005/0160704 A1 Jul. 28, 2005

(30) Foreign Application Priority Data

Jan. 22, 2004 (DE) ..... 10 2004 003 232

(51) Int. Cl.
*B65B 43/30* (2006.01)
*B65B 43/40* (2006.01)

(52) U.S. Cl. ..... 53/381.4; 53/386.1

(58) Field of Classification Search ..... 53/381.4, 53/382.1, 381.6, 383.1, 386.1, 387.3
See application file for complete search history.

(56) References Cited

U.S. PATENT DOCUMENTS 4,641,482 A * 2/1987 Metz ..... 53/387.3
4,781,013 A * 11/1988 DePasquale et al. ..... 53/569
5,048,260 A * 9/1991 Raymond et al. ..... 53/370.8
5,333,437 A * 8/1994 Conti ..... 53/284.3
5,353,572 A * 10/1994 Shigeta ..... 53/371.5
5,598,686 A * 2/1997 Owen ..... 53/492
6,878,345 B1 * 4/2005 Astle ..... 422/102
7,021,033 B2 * 4/2006 Close et al. ..... 53/492

FOREIGN PATENT DOCUMENTS

DE 44 19 475 A1 12/1995
DE 199 22 902 A1 11/2000
EP 0 443 502 A1 8/1991
EP 1 279 603 A1 1/2003

* cited by examiner

*Primary Examiner*—Rinaldi I Rada
*Assistant Examiner*—John Paradiso
(74) *Attorney, Agent, or Firm*—Michael J. Stricker

(57) ABSTRACT

The present invention relates to a method and a device for removing a cover from a storage box that is closed using a lid-like cover attached thereto at the edges. For removal, the adhesive strength of the cover is reduced in the region of a few of the sealed edges and the cover is then removed by peeling it off the storage box, whereby the cover is peeled off by rolling it onto a roller.

4 Claims, 2 Drawing Sheets

METHOD AND DEVICE FOR REMOVING A COVER FROM A STORAGE BOX

BACKGROUND OF THE INVENTION

The present invention concerns a method for removing a cover from a storage box, in particular from a storage box filled with prefabricated, disposable syringes.

Typically, prefabricated, disposable syringes, for example, are transported in storage boxes in which they are secured in a hanging arrangement in a perforated tray. The tray sits loosely on a ledge projecting from the inner circumference of the storage box. After the disposable syringes are inserted, the top side of each storage box is closed with a lid-like cover which is connected with the circumferential edge of typically nearly rectangular storage boxes. The connection and the cover itself must be germ-proof. In addition, a second cover is placed loosely underneath this first cover before the first cover is installed, e.g., for cushioning purposes or the like. The storage boxes are sterilized in this state and, in fact, on the exterior and the interior through the cover, so that the disposable syringes and a loosely inserted inner cover contained therein are also sterilized; in this state, and packed in individual, sterile bags, for example, they are delivered to pharmaceutical companies, where the disposable syringes are filled with a pharmaceutical product in automated filling and sealing machines. To fill the disposable syringes delivered in the storage boxes, the lid-like, top cover and, if applicable, a further, loosely inserted second cover must be removed. The removal process must take place under sterile conditions. This process is often performed manually by an operating personnel wearing a glove who reaches into a sterile region of the machinery (isolator). Due to the use of the gloved hand, the operating personnel is involved in this process, although only two to three storage boxes must be opened every minute, for example.

A device for removing the cover from storage boxes is furthermore known (DE 44 19 475 A1), the device including a gripper device with gripping claws, a transport device, and further complex mechanical means for removing the top cover. A device of this type is complicated and laborious, requires a great deal of space, and is very expensive. In addition, using a device of this type does not always ensure that the top cover will be gripped securely, e.g., because the cover, which extends a few mm past the edge of the storage box and only at the edges, is often bent upward or downward and therefore cannot be gripped securely. Nor can it be ruled out that the cover will tear while it is being pulled off and will not be removed completely.

SUMMARY OF THE INVENTION

The object of the present invention is to create a method of the type stated initially, which enables removal of a cover from a storage box in a reliable manner under sterile conditions.

Due to the fact that the adhesive strength of the cover is reduced in the region of a few of the sealed edges, e.g., just the transverse edges, and the cover is removed from the storage box by peeling it off, reliable removal of the cover is attainable and, in fact, without the risk that the cover will tear or not be removed completely, whereby this method requires only a small amount of mechanical outlay. The invention makes use of the knowledge that adhesive bonds have the least amount of resistance to separation by peeling, therefore making it possible, with great advantage, to carry out peeling with a small amount of force and in a reliable manner without the risk of tearing, even when storage box covers are involved. It is advantageous when the reduction in the adhesive strength of the cover takes place in the region of a seal of a few of the sealed edges, e.g., the transverse edges. The reduction in the adhesive strength of the cover can be accomplished in an advantageous manner via warming at least in the region of a few of the sealed edges, e.g., the transverse edges. It can be advantageous when the cover is acted upon from above by heating energy, in particular radiant heat, acting upon the region of a few of the sealed edges, in particular the transverse edges, at the least.

A further advantageous configuration provides that the cover is acted upon with a suction force and is removed from the storage box using this suction force. It can be advantageous when the cover is acted upon with a suction force at least in the region of a transverse edge and is removed from the associated transverse edge of the storage box using the suction force at least in the region of this transverse edge. The cover is peeled off in an advantageous manner by rolling it off of the storage box. It is advantageous when the cover is separated from the storage box by peeling it off in the region of the sealed edges, the storage box being held down while this is taking place. The peeling away of the cover by rolling it up is initiated simultaneously with the application of the suction force, whereby the cover can be rolled onto a roller positioned above the storage box. The suction force can be applied using suction devices, for example, in particular suction cups, located lengthwise in at least one row on the roller, with suction openings or the like which are connected to a vacuum source. The cover, which has been removed from the storage box and rolled up, can be unrolled in the opposite or same direction of the rolling-up, outside the region of the storage box and, as a result of the suction force being reduced, is released and dropped through a discard opening.

In this manner, a lid-like top cover, which is sealed to the storage box at the edges, is capable of being removed in a reliable, fast and economical manner under sterile conditions.

The present invention further concerns a method for removing a cover from a storage box, which is placed loosely on the top of or in the storage box. According to the present invention, this cover is acted upon by a suction force and removed from the storage box using this suction force. The cover is advantageously acted upon by a suction force at least in the region of a transverse edge and lifted using the suction force. The cover is then rolled up to remove it from the storage box. The removal of the cover by rolling it onto a roller located above the storage box is initiated simultaneously with the application of the suction force. The suction force is advantageously applied using suction devices, for example, in particular suction cups, located lengthwise in at least one row on the roller, with suction openings or the like which are connected to a vacuum source. The cover, which has been removed from the storage box and rolled up in this manner, can be unrolled in the opposite or, preferably, the same direction of the rolling-up, outside the region of the storage box and, as a result of the suction force being reduced, it is released and dropped through a discard opening.

According to the method according to the present invention, storage boxes which also contain a top cover sealed at the edges and a loosely inserted cover can be handled in the manner described.

In this case it is advantageous when, in continuous sequence as the storage boxes are conveyed along, a first cover is removed in a first step by reducing the adhesive strength of the cover in the region of a few sealed edges, in particular the transverse edges, and peeling it off of the storage box and, in a subsequent, second step, a second cover which is contained loosely in the storage box is removed from the storage box. It can be advantageous when the removed and rolled-up first cover and, therefore, at least nearly simultaneously therewith, the removed and rolled-up second cover are unrolled preferably in opposite directions, outside the region of the storage box, and, as a result of the particular suction force being reduced, they are dropped through the same discard opening. By using this method to discard the covers, they can hang down nearly vertically very close together and be dropped into the same discard opening below; the discard opening can be narrow in size due to the closeness of the covers. From the discard opening, the items are then sent to the outside through a channel, a slot or the like, for example.

A further object of the present invention is a device for removing at least one cover from a storage box. Further advantageous features and embodiments of the present invention result from the related subclaims. This device enables sterile handling by utilizing placement inside an isolator. No manual handling by operating personnel is required, since the device enables automatic, continuous operation. The device is compact, simple, operationally reliable, and economical due to its simple design.

DETAILED DESCRIPTION OF THE PREFERRED EMBODIMENTS

Figure 1:
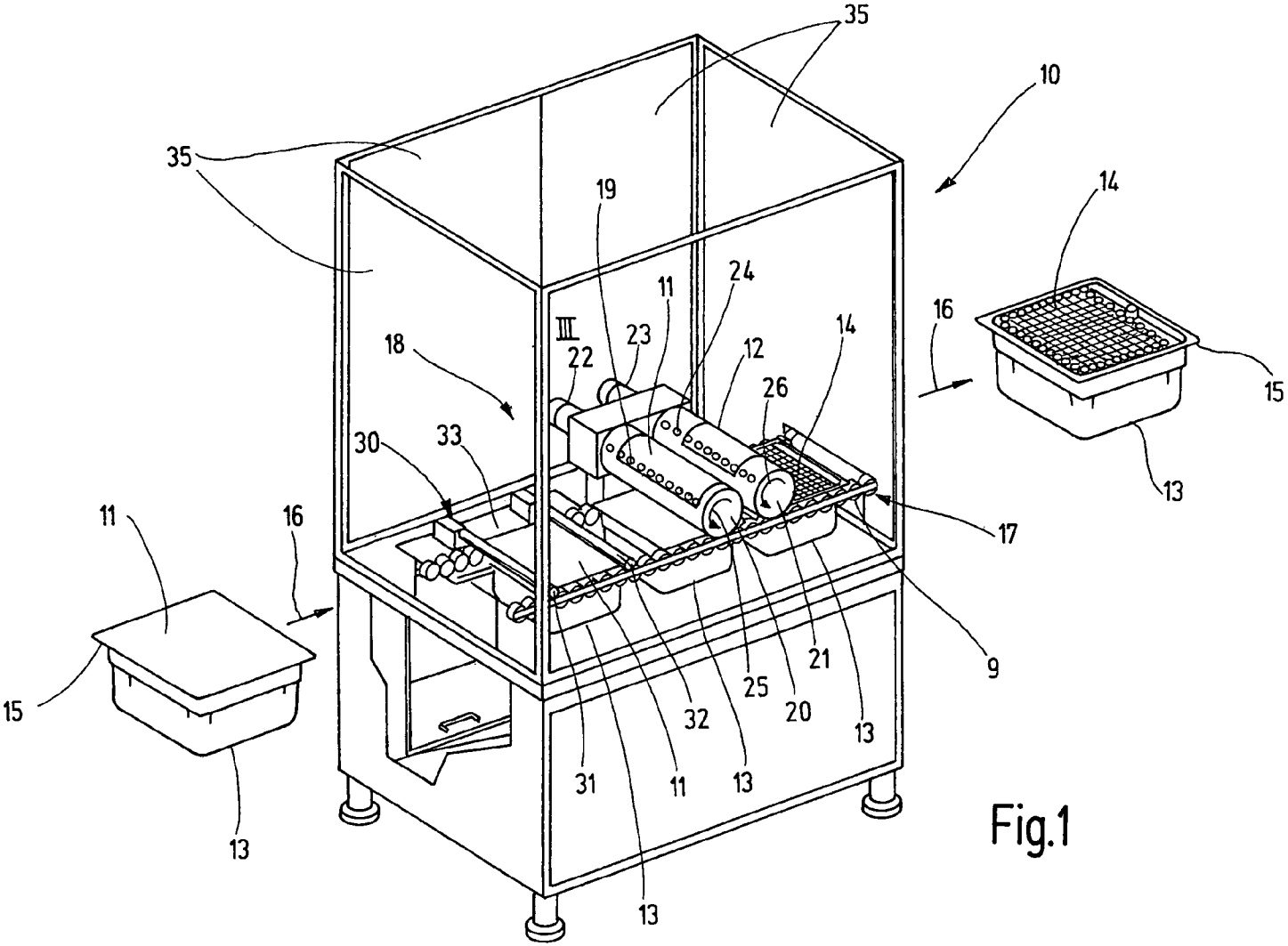
FIG. 1 is a schematic perspective view of a device for removing covers from storage boxes.

The drawing shows a device 10 designed for removing at least one cover 11 and 12 from individual storage boxes 13. These storage boxes 13 are preferably storage boxes which are filled with prefabricated disposable syringes 14 which have not yet been filled. They are positioned such that they hang in storage box 13, e.g., in a perforated tray which sits loosely on a ledge projecting circumferentially from the side walls of storage box 13. After being filled, storage boxes 13 are closed with a lid-like cover 11 which is joined via sealing with circumferential edge 15 of storage box 13. Cover 11 and this seal along edge 15 must be germ-proof, whereby cover 11 must still be detachable from edge 15 without cover 11 tearing or splitting and leaving parts of it behind. In addition, cover 11 must be designed such that disposable syringes 14 can be sterilized through it, usually using steam-based or gaseous sterilizing means. Each storage box 13 is often provided with a second cover 12, which is inserted in storage box 13 before first cover 11 is installed, and is placed loosely on top of disposable syringes 14. Storage boxes 13 are delivered in this closed and sterilized form. To now enable the disposable syringes contained in storage boxes 13 to be filled and closed in a filling and sealing device, first cover 11 and second cover 12, if applicable, must be removed. This takes place using device 10.

Device 10 includes a transport device 17 which transports storage boxes 13 with space between each one preferably continually along a path, which is indicated in a simplified manner using an arrow 16, the transport device including a roller track 9, for example, which extends in a straight line in particular and on which the individual storage boxes 13 sit loosely, for example, with their longitudinal edges extending in the direction nearly parallel with arrow 16 and being movable forward in the transport direction indicated by arrow 16. Furthermore, device 10 includes at least one roller station 18 with at least one suction device 19 which removes and securely holds a cover 11 using suction force, and at least one roller 20 which rolls up this securely-held cover 11. In the exemplary embodiment shown, roller station 18 includes two rollers 20 and 21 which are positioned nearly parallel with each other and at the same height, whereby rollers 20, 21 are located one behind the other, with space between them, in the transport direction, as indicated by arrow 16. A drive 22 and 23 is assigned to each roller 20, 21, each drive preferably being reversable in terms of the direction of rotation. Second roller 21 is provided with at least one suction device 24 in the same manner as first roller 20. Particular suction device 19, 24 on each roller 20 or 21 includes suction devices, in particular suction cups, located, e.g., lengthwise in at least one row on roller 20, 21, with suction openings or the like which are connected to a vacuum source, whereby, in the drawing, suction openings are shown in the jacket of particular roller 20 or 21 as suction device 19 and/or 24 of this nature.

First roller 20 with suction device 19 is designed to remove and roll up the first, preferably top, sealed cover 11, and is positioned as the first roller upstream of second roller 21 as viewed in the transport direction indicated by arrow 16.

Second roller 21 with suction device 24 is designed for the preferably subsequent removal and rolling up of second cover 12, which preferably sits loosely in particular storage box 13. Both rollers 20, 21 preferably rotate in the same direction when rolling up associated cover 11 or 12, as indicated by arrows 25 and 26 in FIGS. 1 through 3 in particular; after this, both rollers 20, 21 rotate in the counterclockwise direction.

At least one schematically indicated heating device 30 is located above the path indicated by arrow 16, the heating device including at least one and preferably two radiant heaters 31, 32 positioned with space between them in the transport direction. Heating device 30 is located upstream of roller station 18 as viewed in the transport direction, whereby these—preferably the individual—radiant heaters 31, 32 extend transversely to the transport direction and extend at least across the entire track width and, therefore, across the entire width of storage boxes 13 such that, when storage boxes 13 are conveyed along, cover 11 is acted upon and warmed up in the region of the front and back transverse edge and, preferably the longitudinal edges on both sides, if necessary, before storage box 13 reaches the operating region of first roller 20. Using heating device 30, top cover 11, which is sealed to storage box 13 on the edges, is capable of being acted upon in the region of at least the transverse edges with radiant heat when storage boxes 13 pass through such that the adhesive strength of the edge seals are reduced there at least to the extent that cover 11 is removable at the edges from storage box 13 by peeling it off.

Figures 2, 3, 4, 5, 6:
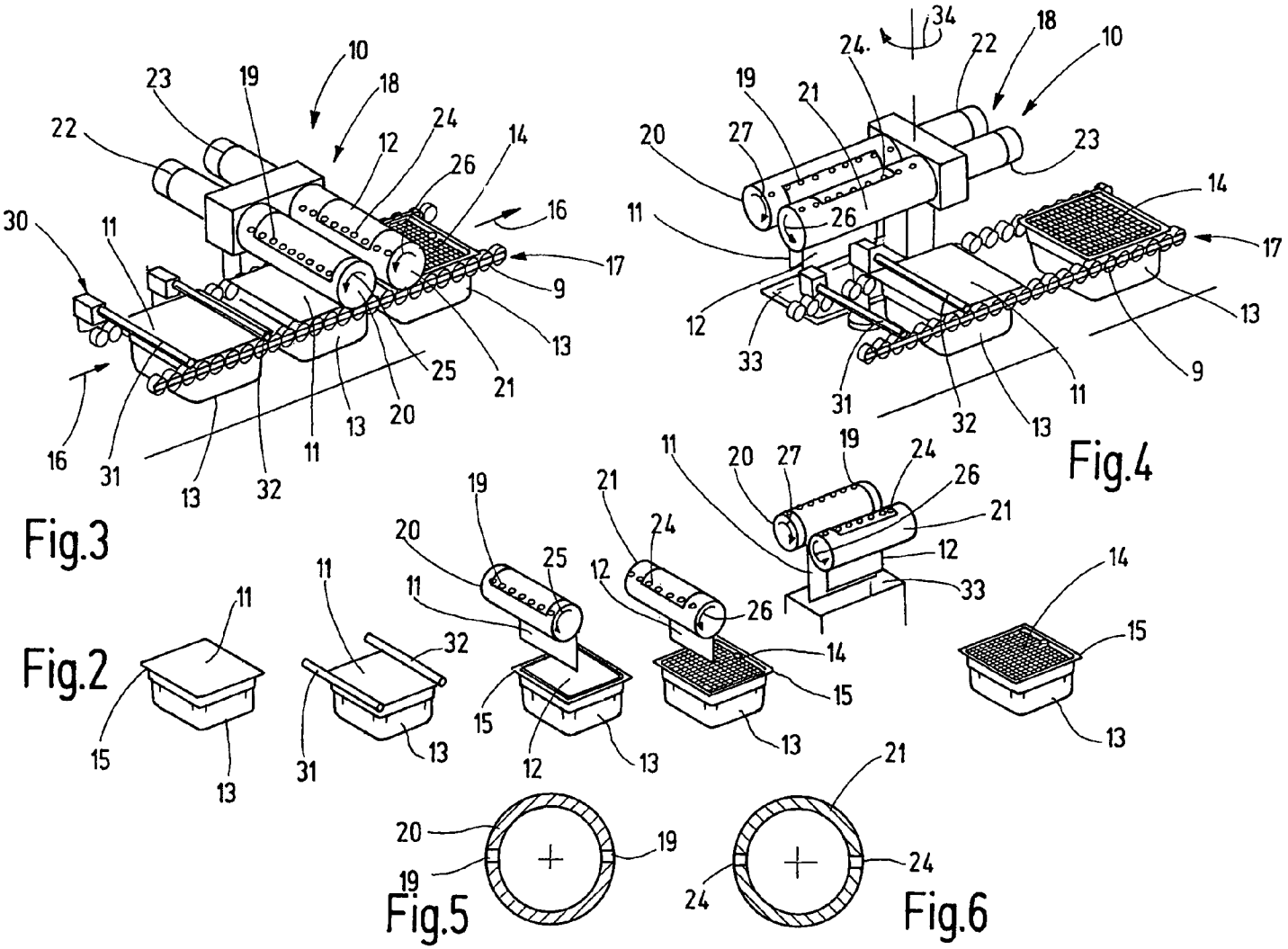
FIG. 2 is a schematic perspective view of individual method steps as the storage boxes are conveyed along and covers are removed.
FIG. 3 is a schematic perspective view of a detail III of the device in FIG. 1 shown in an enlarged dimension, whereby the roller station is located in its starting position.
FIG. 4 is a schematic, perspective view which nearly corresponds to that in FIG. 3, in the case of which the roller station has been swiveled into a discard position.
FIGS. 5 and 6 are each a schematic cross-section of a roller in the roller station.

When individual storage boxes 13 are transported along path 16, e.g., a storage box reaches the operating region of radiant heater 31 with the front transverse edge first; using the radiant heater, this front transverse edge is warmed up using radiant heat such that the adhesive strength is reduced at least in the region of this front transverse edge. As conveyance continues, the two longitudinal edges of storage box 13 can then be acted upon by radiant heater 31, as needed. The rear transverse edge is then warmed up accordingly. Heat is applied by radiant heater 32 in the same manner. After this preheating of the edge seals, their adhesive strength is reduced to the extent that first cover 11 can be removed from storage box 13 in the region of front transverse edge using the suction force applied by suction device 19. When cover 11 passes first roller 20, its suction device 19 grips, via suction, cover 11 in the region of this front transverse edge; the suction device is capable of lifting both cover 11 and storage box 13 together. Due to the rotation of first roller 20 in the direction of arrow 25, first cover 11 is then peeled off of storage box 13 by being rolled onto roller 20. Storage box 13 is pulled against roller 20, which holds it down. A special holding-down device for individual storage boxes 13 is therefore not required, but it can be advantageous under certain circumstances. Suction force is applied to cover 11 by the suction openings of suction device 19 along at least one row on roller 20, the suction openings being connected with a controllable vacuum source which is not shown. Cover 11, which has been completely removed from storage box 13 and rolled onto roller 20, can now be unrolled outside the region of storage box 13 in the same direction or, preferably, in the opposite direction, as indicated by arrow 27, of the rolling-up direction of roller 20 and, as a result of the suction force being reduced, they are released and dropped through a schematically indicated discard opening 33 of device 10. To this end, after particular cover 11, 12 is rolled up, roller station 18 and both rollers 20, 21 are capable of being swiveled out of the region of roller track 9 and storage boxes 13 and into a discard position, which is shown in FIG. 4, in which both rollers 20, 21 are located above discard opening 33. Roller station 18 is swiveled out of its starting station in the direction of arrow 34 by approximately 90° in the discard position shown. To this end, a drive, which is not shown, acts on roller station 18. In this discard position according to FIG. 4, the two rollers 20, 21 are controllable by assigned drives 22, 23 such that, e.g., roller 20 now rotates in a direction opposite to the rolling-up direction and, therefore, in the clockwise direction, as indicated by arrow 27, while the direction of rotation of the other roller 21 remains in the direction of arrow 26. Both rollers 20, 21 now therefore rotate in opposite directions in the discard position. They are then able—with suction devices 19 and 24 switched off—to release covers 11 and 12 rolled onto them by unrolling them and dropping them in the vertical direction downward into discard opening 33 located below. Roller station 18 is then swiveled back into its starting position as shown in FIG. 3. It is understood that, if second cover 12 is not present, device 10 operates without second roller 21 and its drive 23. For storage boxes 13 that contain a second cover 12 placed loosely on the top, this second cover 12 is detected using second roller 21 via suction force action and is removed from storage box 13 using suction force. First, cover 12 is acted on with suction force at least in the region of a transverse edge, e.g., the front transverse edge, and is lifted using this suction force; it is then rolled onto second roller 21 and thereby removed from storage box 13. Removal of cover 12 by rolling it up can be initiated simultaneously with the application of the suction force. By equipping storage boxes 13 with two covers 11, 12, the following steps take place in continuous sequence as storage boxes 13 are conveyed along: In a first step, first cover 11 is removed as a result of the adhesive strength of cover 11 being reduced in the region of a few sealed edges 15 and peeling it off of storage box 13 in the manner described and, in a subsequent, second step, removing the other cover 12 from this storage box 13. After first cover 11 is removed, storage box 13 passes roller 21, by way of which the suctioning off and rolling up of second cover 12 takes place. The arrangement is designed such that the removed and rolled-up first cover 11 and, therefore, and at least nearly simultaneously therewith, the removed and rolled-up second cover 12 are then unrolled in opposite directions outside the region of storage box 13, namely in the discard position according to FIG. 4, so that they hang vertically downward substantially close to each other and nearly parallel with each other and, as a result of the particular suction force being reduced, are discarded into shared discard opening 33.

Roller station 18 with rollers 20, 21 and assigned suction devices 19 and 24, and heating device 30 are contained in an interior space of device 10 enclosed by walls 35, as is transport device 17, to which storage boxes 13 are supplied from the outside, and from which they are dispensed back to the outside after covers 11, 12 are removed. Sterile conditions exist in the interior space of device 10.

Device 10 and the mode of operation described above have many diverse advantages. Device 10 is simple and economical, space-saving and enables reliable removal of the at least one cover 11, 12, at least substantially under sterile conditions without requiring intervention by operating personnel or the like to remove cover 11, 12. The power required by roller station 18 with the at least one roller 20, 21 to remove cover 11, 12 is minimal. In terms of removing cover 11 via peeling off, device 10 makes use of the fact that, by warming up the at least transversely extending parts of the sealing seam on the edge between cover 11 and storage box 13, its adhesive strength is reduced to the extent that, when roller 20 and its suction device 19 are reached, it is possible to lift cover 11 using suction force and then peel it off and roll it up using a peeling-off motion with minimal use of force. A special holding-down device for storage box 13 is not required, because storage box 13 is pulled against roller 20 during application of suction force, which results in its being held down when the rollers rotate and roll up cover 11.

Roller 20 can include, as suction device 19, a plurality of rows with suction openings, suction cups or the like, e.g., two rows which are positioned such that they are offset by approximately 180° in the circumferential direction. A plurality of rows of this type is also feasible, whereby the number of suction openings is advantageously selected in accordance with the requirements such that only a small amount of air is required for suctioning and holding, and the particular cover 11, 12 which is suctioned up and held tightly is released easily and quickly from the roller when it is time to release it from the particular roller 20, 21 by reversing the suction air. The same considerations also apply for roller 21. Since it rotates in the same direction of rotation, as indicated by arrow 26, when releasing cover 12 as it does when rolling it up, then, to release cover 12, suction device 24, in the form of a row of suction openings, is first reversed to release cover 12, while another suction device 24, which is located such that it is offset by a 180° angle at circumference, keeps supplying suction force to retain cover 12 while roller 21 rotates until it is located in a vertical direction relative to discard opening 33 and is close to it.

The invention claimed is:

1. A device for removing two covers (11, 12) from a storage box (13), comprising a transport device (17) transporting the storage boxes (13) with space between each one and along a path, and at least one roller station (18) with two suction devices (19, 24) which lift and securely hold the two covers (11, 12) using suction force, and two rollers (20, 21) which roll up the securely-held covers (11, 12) and are located one behind the other, with space between them, in the transport direction, with associated drives (22, 23), each of which includes a separate, controllable suction device (19, 24), said suction device (19, 24) on each roller (20, 21) includes suction devices (19), with suction openings which are in at least one row with the roller and are connected to a vacuum source, at least one heating device (30) is located above a track, via which first one of the covers (11), sealed on the particular storage box (13) at the edge, is acted upon with radiant heat—as the storage boxes (13) pass through—in the region of a few of the sealed edges (15), in particular transverse edges, to reduce an adhesive strength and therefore to reduce resistance to separation by peeling, wherein a first one of the rollers (20) is designed with a suction device (19) for removing and rolling up the first top, sealed-on cover (11) and is located as the first roller (20) upstream of a second one of the rollers, as viewed in the transport direction, and a second roller (21) is designed with a suction device (24) for the subsequent removal and rolling up of a second cover (12) which is placed loosely in the storage box (13), and both rollers (20, 21) rotate in the same direction of rotation for rolling up, and wherein the heating device (30) is located upstream of the roller station (18), as viewed in the transport direction wherein the roller station (18), the cover (11, 12) and the drive (22, 23) are configured so that after the cover (11, 12) is rolled up, the roller station (18), together with the rollers (20, 21), is swiveled away from the region of the track and the storage boxes (13), by approximately 90°, into a discard position and over a discard opening (33), at least one roller (20, 21) is driveable in the discard position using the particular associated drive (22, 23) in a direction opposite to the rolling-up position and, when the particular suction device (19, 24) is turned off, discards the particular rolled-up cover (11, 12) by unrolling it into the discard opening (33), and after the covers (11, 12) are discarded, the roller station (18) is swiveled out of the discard position and back into its starting position.

2. The device as recited in claim 1, wherein the heating device (30) includes two radiant heaters (31, 32) located with space between them in the transport direction.

3. The device as recited in one of the claim 1, wherein the transport device (17) includes a roller track (9) which extends in a straight line in particular, on which the storage boxes (13) lie with their longitudinal edges and are capable of being moved forward in the transport direction.

4. A device for removing two covers (11, 12) from a storage box (13), comprising a transport device (17) transporting the storage boxes (13) with space between each one and along a path, and at least one roller station (18) with two suction devices (19, 24) which lift and securely hold the two covers (11, 12) using suction force, and two rollers (20, 21) which roll up the securely-held covers (11, 12) and are located one behind the other, with space between them, in the transport direction, with associated drives (22, 23), each of which includes a separate, controllable suction device (19, 24), said suction device (19, 24) on each roller (20, 21) includes suction devices (19), with suction openings which are in at least one row with the roller and are connected to a vacuum source, at least one heating device (30) is located above a track, via which first one of the covers (11), sealed on the particular storage box (13) at the edge, is acted upon with radiant heat—as the storage boxes (13) pass through—in the region of a few of the sealed edges (15), in particular the transverse edges, to reduce an adhesive strength and therefore to reduce resistance to separation by peeling, wherein a first one of the rollers (20) is designed with a suction device (19) for removing and rolling up a first top, sealed-on cover (11) and is located as the first roller (20) upstream of a second one of the rollers, as viewed in the transport direction, and a second roller (21) is designed with a suction device (24) for the subsequent removal and rolling up of a second cover (12) which is placed loosely in the storage box (13), and both rollers (20, 21) rotate in the same direction of rotation for rolling up, wherein the heating device (30) is located upstream of the roller station (18), as viewed in the transport direction, and wherein the heating device (30) is located transverse to the transport direction and extends at least across the entire track width such that, when the storage boxes (13) pass through, a cover (11) is acted upon and warmed up in the region of the front and rear transverse edge wherein the roller station (18), the cover (11, 12), and the drive (22, 23) are configured so that after the cover (11, 12) is rolling up, the roller station (18), together with the rollers (20, 21), is swiveled away from the region of the track and the storage boxes (13), by approximately 90°, into a discard position and over a discard opening (33), at least one roller (20, 21) is driveable in the discard position using the particular associated drive (22, 23) in a direction opposite to the rolling-up position and, when the particular suction device (19, 24) is turned off, discards the particular rolled-up cover (11, 12) by unrolling it into the discard opening (33), and after the covers (11, 12) are discarded, the roller station (18) is swiveled out of the discard position and back into its starting position.

* * * * *